United States Patent [19]

Bachrach et al.

[11] Patent Number: 4,622,842

[45] Date of Patent: Nov. 18, 1986

[54] DIE FOR EXTRUDING TOOTHED HELICAL MEMBERS

[75] Inventors: Benjamin I. Bachrach, Dearborn; William J. Fuhrman, Bloomfield Hills; Daniel W. Hall, Plymouth; G. S. Hauser, Southfield, all of Mich.

[73] Assignee: Ford Motor Company, Dearborn, Mich.

[21] Appl. No.: 681,345

[22] Filed: Dec. 13, 1984

[51] Int. Cl.[4] ..... B21C 25/02

[52] U.S. Cl. ..... 72/467; 72/253.1

[58] Field of Search ..... 72/467, 253.1, 260; 29/159.2

[56] References Cited

U.S. PATENT DOCUMENTS

| | | | |
|---|---|---|---|
| 3,186,210 | 6/1965 | Lesher et al. | 72/467 |
| 3,605,475 | 9/1971 | Eakin et al. | 72/260 |
| 3,713,323 | 1/1973 | Ivanier | 72/467 |
| 3,910,091 | 10/1975 | Samanta | 72/256 |
| 4,287,749 | 8/1981 | Bachrach et al. | 72/467 |
| 4,350,865 | 9/1982 | Bachrach | 219/69 |

FOREIGN PATENT DOCUMENTS

| | | | |
|---|---|---|---|
| 7514252 | 6/1977 | Netherlands | 72/467 |
| 321017 | 10/1929 | United Kingdom | 72/467 |
| 302150 | 4/1971 | U.S.S.R. | 72/467 |
| 445492 | 10/1974 | U.S.S.R. | 72/467 |

*Primary Examiner*—Daniel C. Crane

[57] ABSTRACT

A die for use in extruding helical gears includes a die orifice at the upper end of the die teeth where the extrusion blank first enters the die. Each tooth is formed with a land directed parallel to the helix on the drive and trail side of the tooth and an end face perpendicular to the helix that intersects either a transition surface, directed perpendicular to the die axis, or a land. Alternatively, the end face can extend entirely across the tooth width from one land to the other without the use of the transition surface. Relief surfaces slope inwardly from the land and provide spaces within which the extrusion blank may expand without undue frictional contact with the die.

4 Claims, 6 Drawing Figures

DIE FOR EXTRUDING TOOTHED HELICAL MEMBERS

BACKGROUND OF THE INVENTION

1. Field of the Invention

This invention relates to an extrusion die and in particular to a helical gear extrusion die.

2. Description of the Prior Art

In the process of forming articles by extruding metal through a die having the contour of the part to be formed, it is known that the extrusion expands radially outward after being forced through the forming surface of the die. The radial expansion is a result of elastic deformation of the extrusion blank when the blank is forced through the forming throat of the die. The strain energy stored in the blank is released after the blank passes the forming surface of the die. As the blank is forced through the die past the forming land, enormous pressures are required in order to reshape the cylindrical outer surface of the extrusion blank into a fluted surface having helical teeth. The metal blank flows around the end faces of the teeth of the die and past the extrusion land where the form of the teeth and the size and direction of the helix angle are established. Enormous pressure is required in the process of forcing the blank through this constricted space and large stresses are developed in the teeth of the die, particularly in the region of its end face where the extrusion blank undergoes the most extreme dimensional change.

The extrusion process is facilitated by lubricating the extrusion blank so that it passes more readily through the constricted orifice of the die. In the prior art, such as that discussed in U.S. Pat. Nos. 3,910,091 and 4,287,749, the end faces of the die teeth, at the die orifice, are substantially planar although inclined in the direction that the blank passes through the die. This inclination produces a lead or transition surface having a component in the axial direction.

It is preferred that an extrusion die for forming helical gears also have, in addition to a lead surface tending to direct the die blank material in the radial direction, a transition or lead surface directed circumferentially with respect to the axis of the die.

Furthermore, an extrusion die for this purpose having lead surfaces that facilitate the passage of the die blank through the die orifice must provide sufficient strength of the die teeth in relation to the compression, bending, tension and shear stresses developed in the die teeth in the vicinity of the forming orifice.

SUMMARY OF THE INVENTION

The hollow extrusion die according to the present invention is adapted to form helical gears from a cylindrical extrusion blank, which is forced parallel to the axis of the die through an orifice defined by surfaces on the die teeth located at the entrance to the die. The die has spaced helical teeth on its interior surface, each tooth having, at the axial end where the blank enters the die, several surfaces including an end face directed substantially perpendicular to the helix, extending across at least a portion of the tooth width, and inclined axially downward and radially inward from the base of the tooth to the crown of the tooth. Each tooth may also have a transition surface intersecting the end face, which is directed substantially perpendicular to the axis of the die and is similarly inclined axially downward and radially inward from the base of the die tooth to the crown of the tooth. Forming orifices defined by the space between lands on the drive and trail sides of the die teeth are directed parallel to the helix, intersect the first transition surface and extend along a sufficient portion of the tooth length to adequately form the die blank. The width of each die tooth at the forming orifice is slightly larger than the width elsewhere because of a relief surface that extends substantially along the length of the die from the exit of the forming orifice to the end of the die where the formed blank exits the die. The relief surface gradually reduces the thickness across the width of the tooth by 0.004 to 0.005 inch in order to reduce the magnitude of frictional force that would otherwise develop along the die tooth length due to elastic and plastic expansion of the die blank after it clears the forming orifice.

DESCRIPTION OF THE PREFERRED EMBODIMENTS

Figure 1:
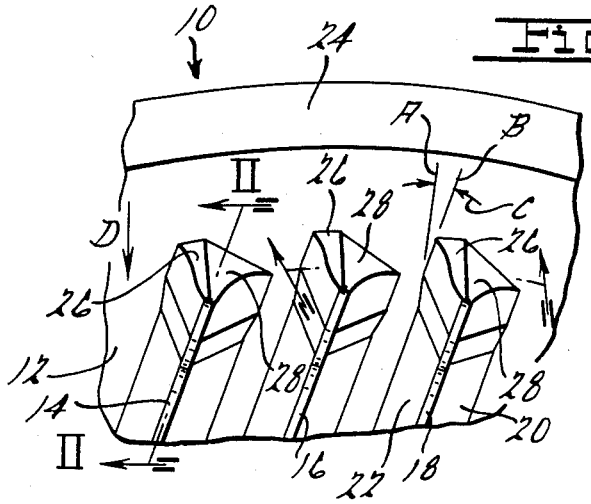
FIG. 1 is a partial view of the interior surface of an extrusion die showing helical die teeth viewed radially outward from the central axis of the die.

Turning now to a more specific description of this invention, attention is first directed to FIG. 1, which shows a hollow die 10 having an internal cylindrical surface 12 and multiple adjacent helical die teeth 14, 16, 18 extending from the base of the tooth on the cylindrical surface radially inward toward the central axis of the die to the crest of the tooth. Line A, at the base of the tooth, is parallel to the central axis of the die. Line B, at the base of the tooth, is parallel to the helix. Angle C, the included angle defined by the intersection of lines A and B is the helix angle whose size may approximate 22 degrees. Each tooth has a face 20 on the trail side of the crest and a face 22 on the drive side of the crest. The extrusion blank is inserted in the direction from the upper surface 24 of the die and forced downwardly in the direction of vector D.

The die is formed from M4 tool steel hardened to Rockwell C-64. An acceptable material for the extrusion blank is SAE 4027 low alloy molybdenum steel in the spheroidized annealed condition. After the blank is extruded, it is carbo-nitride case hardened. Before extrusion, each blank is phosphate coated, coated with a stearate soap, and tumbled in molybdenum disulfide, a black powder lubricant used to facilitate passage of the die blank through the constricted space in the die between the die teeth. Before the blank is extruded it is a hollow right circular cylinder whose outer diameter is slightly less than the inside diameter of the cylindrical surface 12 of the die.

Figure 2:
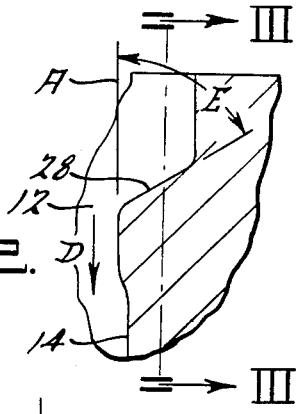
FIG. 2 is a cross section taken at plane II—II of FIG. 1.

FIG. 2 shows that the end faces 26, 28 of the die teeth, at the end where the extrusion blank first enters the die, are inclined downwardly in the direction the blank moves through the die with respect to the axis of the die through an angle E, approximately 60 degrees. Semiconical angles, E, more or less than 60 degrees are also acceptable.

Figure 3:
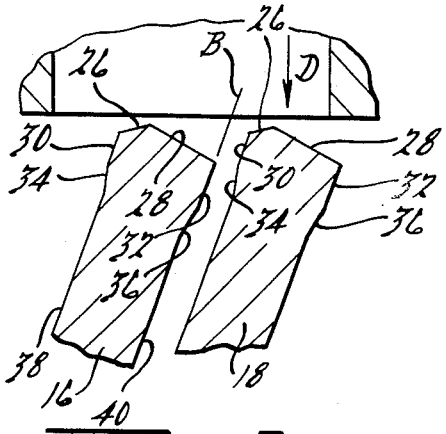
FIG. 3 is a cross section through the thickness of two adjacent die teeth taken outward of the pitch circle at surface III—III of FIG. 2.

FIG. 3 shows a cross section taken at the pitch circle through teeth 16 and 18 of the extrusion teeth. In this cross section, surface 26 appears as a line that is substantially perpendicular to the axis of the die and surface 28 appears as a line that is substantially perpendicular to the helix represented by line B. Surface 28 extends across at least a portion of the width of the tooth, approximately 75 percent of the width of the tooth at the pitch circle measured between the drive and trail sides of the tooth.

Surface 26 is a transition surface extending across the remaining portion of the tooth width, intersecting end face 28 and intersecting a land 30, which is aligned parallel to the helix B. The trace of surface 26 in the pitch circle plane is substantially perpendicular to the axis of the die, but surface 28 is inclined axially from the base of the die tooth to the crown of the die tooth.

As shown in FIG. 3, land 30 intersects the first transition surface 26 and extends along a portion of the length of the tooth. A second land 32 located on the trail side of the tooth is substantially parallel to the helix B, intersects face 28 and, in the pitch circle plane, appears perpendicular to end face 28.

A second transition surface 34 intersects the land 30 and is inclined inwardly away from the land and toward the body of the tooth. Similarly, a transition surface 36 intersects land 32 and is inclined inward away from land 32 toward the body of the tooth. These transition surfaces 34, 36 intersect relief surfaces 38 and 40, which are located, respectively, on the drive and trail sides of the tooth face. Relief surfaces 38 and 40 and inclined inward toward the body of the tooth at a slope of approximately 0.0025 inches per inch of tooth length. Transition surfaces 34 and 36 have a component of length directed inwardly from the respective lands 30 and 32, approximately 0.002 inches and have a component along the length of the tooth of approximately 0.40 inches. Land 30 extends along the length of the tooth approximately 0.10 inches.

Figure 4:
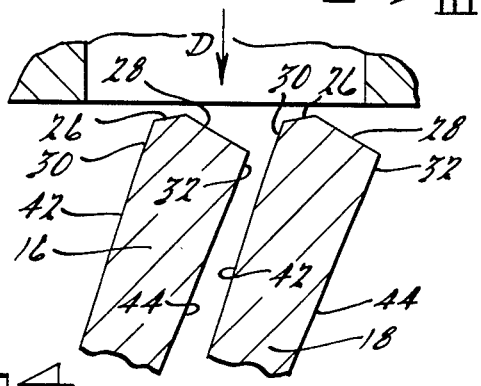
FIG. 4 is a cross section similar to FIG. 3 showing an alternate configuration of the die teeth.

FIG. 4, a cross section outward of the pitch diameter of the die teeth, shows an alternate tooth form in which transition surfaces 34, 36 and relief surfaces 38, 40 have been eliminated from the drive and trail surfaces of the tooth and replaced with relief surfaces 42 and 44, which intersect lands 30 and 32. Relief surfaces 38, 40 are tapered inwardly from the lands toward the body of the tooth each having a component in the direction perpendicular to the lands of approximately 0.0025 inches and a component along the length of the die tooth of approximately 1.40 inches.

Figure 5:
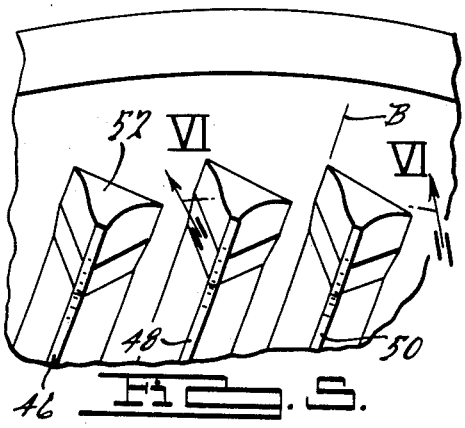
FIG. 5 is a partial view of the interior surface of an extrusion die viewed radially outward from the central axis of the die showing the die teeth of another embodiment of this invention.
Figure 6:
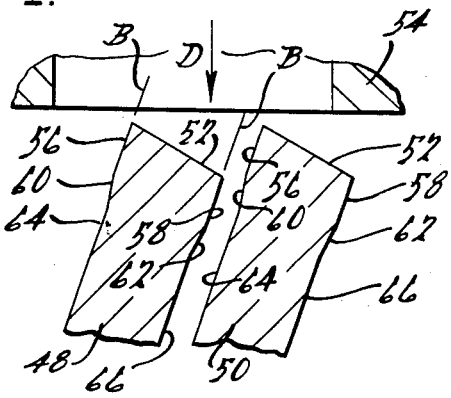
FIG. 6 is a cross section through two adjacent die teeth taken outward of the pitch circle at plane VI—VI of FIG. 5.

FIG. 5 shows an alternate form of the die teeth 46, 48, 50 wherein the end face 52 slopes axially downward from the base of the tooth toward the crest of the tooth and extends also across the full width of the tooth without a transition surface such as 26, described previously with respect to FIGS. 1, 3 and 4. FIG. 6 shows the die teeth of FIG. 5 in cross section taken at the plane through the pitch diameter in the vicinity of the axial end of each tooth where the extrusion blank 54 first enters the die. An orifice is defined between lands 56 and 58 through which the material of the extrusion blank is forced as it moves downwardly in the direction of vector D. The faces 52, which in the cross section appear perpendicular to the helix of the teeth, intersect lands 56, 58 and intersect transition surfaces 60, 62. Surfaces 60, 62 intersect relief surfaces 64, 66 on the drive and trail sides of each tooth. The slope of transition surfaces 60, 62 is comparable to the slope of transition surface 34, 36 previously described with respect to FIGS. 1 and 3 and the slope of relief surfaces 64 and 66 is comparable in magnitude to the slope of relief surfaces 38 and 40, previously described. The helix angle is approximately 22 degrees.

In FIG. 3, the relative widths of the components of end face 28 and transition surface 26 can be varied from the ideal proportion of 75 percent of the tooth width for surface 28 and 25 percent for surface 26. For example, FIG. 6 shows that end face 52 may extend entirely across the width of the teeth with no transition surface. At the other extreme, however, if transition surface 26 were to extend fully across the tooth width, the tooth becomes susceptible to shear failure in the vicinity of the intersection of land 30 and surface 26 as the angle between surface 26 and the helix decreases. It is likely, however, that a successful die tooth configuration would result if transition surface 26 and end face 28 have approximately the same width when measured perpendicular to lands 30 and 32.

Having described the preferred embodiments of our invention, what we claim and desire to secure by U.S. Letters Patent is:

1. A hollow die through which a blank is extruded to form teeth on the surface of the blank comprising:

an inner surface having a central axis, said inner surface defining the passageway through which the blank is extruded, said passageway extending along the axis from the extrusion entry end of the die; and spaced helical die teeth extending along the inner surface, having a helix axis that is inclined with respect to the central axis, each tooth having a base located on the inner surface and a crown located radially inward from the base;

the die teeth including a first planar face extending across a portion of the width of the die teeth and located near the axial end of the die where the blank enters the die, the planar face being directed substantially perpendicular to the helix axis, inclined from the base to the crown radially inward toward the central axis and inclined axially away from the entry and of the die.

2. A hollow die through which a blank is extruded to form teeth on the surface of the blank comprising:

an inner surface having a central axis, said inner surface defining the passageway through which the blank is extruded, said passageway extending along the axis from the extrusion entry end of the die;

spaced helical die teeth extending along the inner surface, having a helix axis that is inclined with respect to the central axis, each tooth having a base located on the inner surface and a crown located radially inward from the base, each tooth having a pitch diameter;

the die teeth including a first planar face extending across a portion of the width of the die teeth and located near the axial end of the die where the blank enters the die, the planar face being directed substantially perpendicular to the helix axis, inclined from the base to the crown radially inward toward the central axis and inclined axially away from the entry end of the die; and a second planar face intersecting the first planar face having a cross section at the pitch diameter that is substantially perpendicular to the central axis.

3. The die of claim 2 further including first and second lands located on opposite lateral faces of the die teeth, directed substantially parallel to the helix axis, the first land intersecting the first end face and the second land intersecting the second end face.

4. The die of claim 3 further including first and second relief surfaces located, on respective opposite lateral faces of the die teeth, each relief surface inclined toward the body of the tooth, inclined with respect to the helix axis and extending along a substantial portion of the length of the teeth, the first relief surface intersecting the first land, the second relief surface intersecting the second land.

* * * * *